US006591562B2

(12) United States Patent
Ting

(10) Patent No.: US 6,591,562 B2
(45) Date of Patent: Jul. 15, 2003

(54) APPARATUS FOR SECURING CURTAIN WALL SUPPORTS

(76) Inventor: Raymond M. L. Ting, 318 Holiday Dr., Pittsburgh, PA (US) 15237

( * ) Notice: Subject to any disclaimer, the term of this patent is extended or adjusted under 35 U.S.C. 154(b) by 0 days.

(21) Appl. No.: 09/933,975

(22) Filed: Aug. 20, 2001

(65) Prior Publication Data

US 2003/0033765 A1 Feb. 20, 2003

(51) Int. Cl.[7] ..... E04H 1/00; E04H 14/00; E04B 1/38

(52) U.S. Cl. ..... 52/235; 52/698

(58) Field of Search ..... 52/235, 698, 711, 52/712

(56) References Cited

U.S. PATENT DOCUMENTS

| | | | | |
|---|---|---|---|---|
| 4,894,973 | A | | 1/1970 | Over |
| 3,802,127 | A | | 4/1974 | Silvernail |
| 3,859,754 | A | | 1/1975 | Budich |
| 3,998,016 | A | | 12/1976 | Ting |
| 4,009,549 | A | * | 3/1977 | Hala |
| 4,078,350 | A | | 3/1978 | Ting |
| 4,086,727 | A | | 5/1978 | Kuyper |
| 4,133,158 | A | | 1/1979 | Ting |
| 4,176,503 | A | | 12/1979 | Ting |
| 4,184,301 | A | | 1/1980 | Anderson |

(List continued on next page.)

OTHER PUBLICATIONS

"Rain Screen Cladding, Air Barriers, and Curtain Walls" by Richard Keleher, pp. 37–40, The Construction Specifier Feb. 2000.

(List continued on next page.)

*Primary Examiner*—Carl D. Friedman
*Assistant Examiner*—Kevin McDermott
(74) *Attorney, Agent, or Firm*—Webb Ziesenheim Logsdon Orkin & Hanson, P.C.

(57) ABSTRACT

A mullion connector connects a mullion to a building structure, the mullion connector having a first flange and a second flange in a plane generally perpendicular to the first flange with a first flange having a first fastener opening capable of allowing relative motion of the mullion connector relative to the mullion in at least one direction and a second flange having an second fastener opening capable of allowing relative motion of the mullion connector relative to the building in at least two generally perpendicular directions. By placing the second flange on a generally horizontal surface such as a building floor, and loosely fastening the second flange through the second fastener opening to a building anchor, the first flange opening may be attached to the mullion allowing up and down and rotational motion while the second flange opening allows in & out and left to right motion while supporting the mullion. In addition, the pre-assembled mullion connector may also be used to hoist the mullion section and attached mullion connector to its assembly position on the face of the building.

9 Claims, 8 Drawing Sheets

U.S. PATENT DOCUMENTS

| | | | | |
|---|---|---|---|---|
| 4,229,905 | A | | 10/1980 | Rush |
| 4,316,351 | A | | 2/1982 | Ting |
| 4,346,538 | A | | 8/1982 | Ting |
| 4,413,458 | A | | 11/1983 | Ting |
| 4,525,966 | A | | 7/1985 | Litchfield et al. |
| 4,570,401 | A | * | 2/1986 | Uebel |
| 4,598,513 | A | | 7/1986 | Gartner |
| 4,625,481 | A | * | 12/1986 | Crandell |
| 4,685,263 | A | | 8/1987 | Ting |
| 4,700,520 | A | | 10/1987 | Ting |
| 4,704,839 | A | | 11/1987 | Kay |
| 4,743,485 | A | | 5/1988 | Ting |
| 4,765,107 | A | | 8/1988 | Ting |
| 4,785,600 | A | | 11/1988 | Ting |
| 4,840,004 | A | | 6/1989 | Ting |
| 4,873,805 | A | | 10/1989 | Ting |
| 4,949,506 | A | | 8/1990 | Durham, Jr. |
| 5,048,248 | A | | 9/1991 | Ting |
| 5,158,392 | A | * | 10/1992 | Takeda |
| 5,230,191 | A | * | 7/1993 | Mayrand |
| 5,247,770 | A | | 9/1993 | Ting |
| 5,265,396 | A | * | 11/1993 | Amimoto |
| 5,323,577 | A | * | 6/1994 | Whitmyer |
| 5,325,579 | A | | 7/1994 | Baier |
| 5,412,922 | A | | 5/1995 | Vittori |
| 5,452,552 | A | | 9/1995 | Ting |
| 5,467,566 | A | * | 11/1995 | Swartz |
| 5,555,682 | A | | 9/1996 | Colitto |
| 5,596,851 | A | | 1/1997 | Ting |
| 5,598,671 | A | | 2/1997 | Ting |
| 5,632,125 | A | * | 5/1997 | Osanai |
| 5,664,392 | A | * | 9/1997 | Mucha |
| 5,687,524 | A | | 11/1997 | Ting |
| 6,018,923 | A | * | 2/2000 | Wendt |
| 6,098,364 | A | * | 8/2000 | Liu |

OTHER PUBLICATIONS

"1600 Wall Screw Spoling Specifications, Pictorial View Details" from Product Specification published by Kawneer Co., Inc. 1987–1989.

"Wausau Guid Specifications: 5" Thermal Barrier Structural Glazed Window System" Model 62506 Guide Specifications & related drawings from Product Specifications published by Wausau Metals Corporation.

"Curtainwall Window Wall Systems" YCW 750 Product Specifications & Pictorial View, pp. El–18 to El–24 & El–1 to El–3, published by YKK America, Inc. 1994.

"Ounce of Prevention", Pittsburgh Business Times, Dec. 17, 1999.

"Tingwall a Revolution in Curtainwall Technology" Brochure published by Advanced Building Systems, Inc. 2000.

* cited by examiner

APPARATUS FOR SECURING CURTAIN WALL SUPPORTS

FIELD OF THE INVENTION

This invention relates to an apparatus and method for securing curtain wall system supports to a building, specifically an improvement to a mullion connection system and erection process while allowing three-directional and rotational adjustability to absorb building erection tolerances.

BACKGROUND OF THE INVENTION

A typical curtain wall system on a building comprises multiple spaced-apart mullion assemblies connected to a building frame or floor slab edges to support multiple curtain wall facing panels that are connected to the mullion assemblies. The primary functions of the assembled mullions and a mullion-supported curtain wall are to provide interior and exterior aesthetic appearance of the building envelope and to provide a weather shield against wind, rain and temperature variations.

It is well known that the aesthetic appearance of a building is related to horizontal and vertical alignments as well as surface contours of the curtain wall panels. It is also well known that significant erection tolerances exist in building frame and floor slab construction that are typically used to support a curtain wall assembly. Therefore, the aesthetic appearance of the curtain wall system typically relies at least in part on the adjustability in field connections and positioning the mullions supporting the curtain wall and an mullion erection process which may include rotational adjustment and three-directional adjustments, i.e. up-and-down; in-and-out; left-and-right position adjustments. Some or all of these adjustments are typically designed into a mullion connection system and process which may include temporary mullion positioning tools and supports, a floor anchoring assembly, an up/down adjusting component, an in/out as well as rotational adjusting component, a left/right adjusting component, and structural connections between the components and the floor anchoring assembly. Due to the multiple structural connections involving multiple position changes, the desired position and connection strength can be compromised by faulty field executions and temporary supports required during the erection process.

SUMMARY OF THE INVENTION

One or more of the principal objectives of the present invention include the following:

(1) to reduce the number of primary mullion connection components to preferably two, a pair of mullion connection clips attachable to a building anchor and a mullion section;

(2) to simplify the position adjustments of the mullion being supported;

(3) to reduce the number of fasteners required to be secured in the field; and (4) to simplify the field hoisting of mullions during erection.

One or more of these and/or other objectives of the present invention are accomplished by preferably providing a self supporting and multi-adjustable mullion connector allowing at least four degrees of positional freedom for connecting a curtain wall support or mullion to a building structure. The preferred mullion connector comprises a first leg and a second leg in a plane generally perpendicular to the first leg, the first leg having a first fastener opening which, in combination with a non-circular mullion fastener opening, absorbs floor slab level tolerance variations. A second leg having a second non-circular fastener opening is capable of absorbing in/out and left/right erection tolerances. By placing the second leg on a generally horizontal surface such as a building floor, and loosely fastening the second leg through the second fastener opening to a building anchor, the first leg opening may be attached to the mullion allowing rotation and up and down adjustment and when combined with the second leg fastener opening allows rotational, in & out, and left to right adjustment while supporting the mullion. In addition, the assembled mullion connector and mullion section in a first configuration may also be used to hoist the mullion section and mullion connector to its assembly position on the face of the building prior to changing the configuration and connecting the assembly to the building.

BRIEF DESCRIPTIONS OF THE INVENTION

In these Figures, it is to be understood that like reference numeral refer to like elements or features.

DESCRIPTION OF THE PREFERRED EMBODIMENT OF THE INVENTION

Although specific reference or references are made to each Figure, in order to better explain the erection procedures, all figures should be considered simultaneously. This is especially true of FIGS. 1–3.

Figure 1:
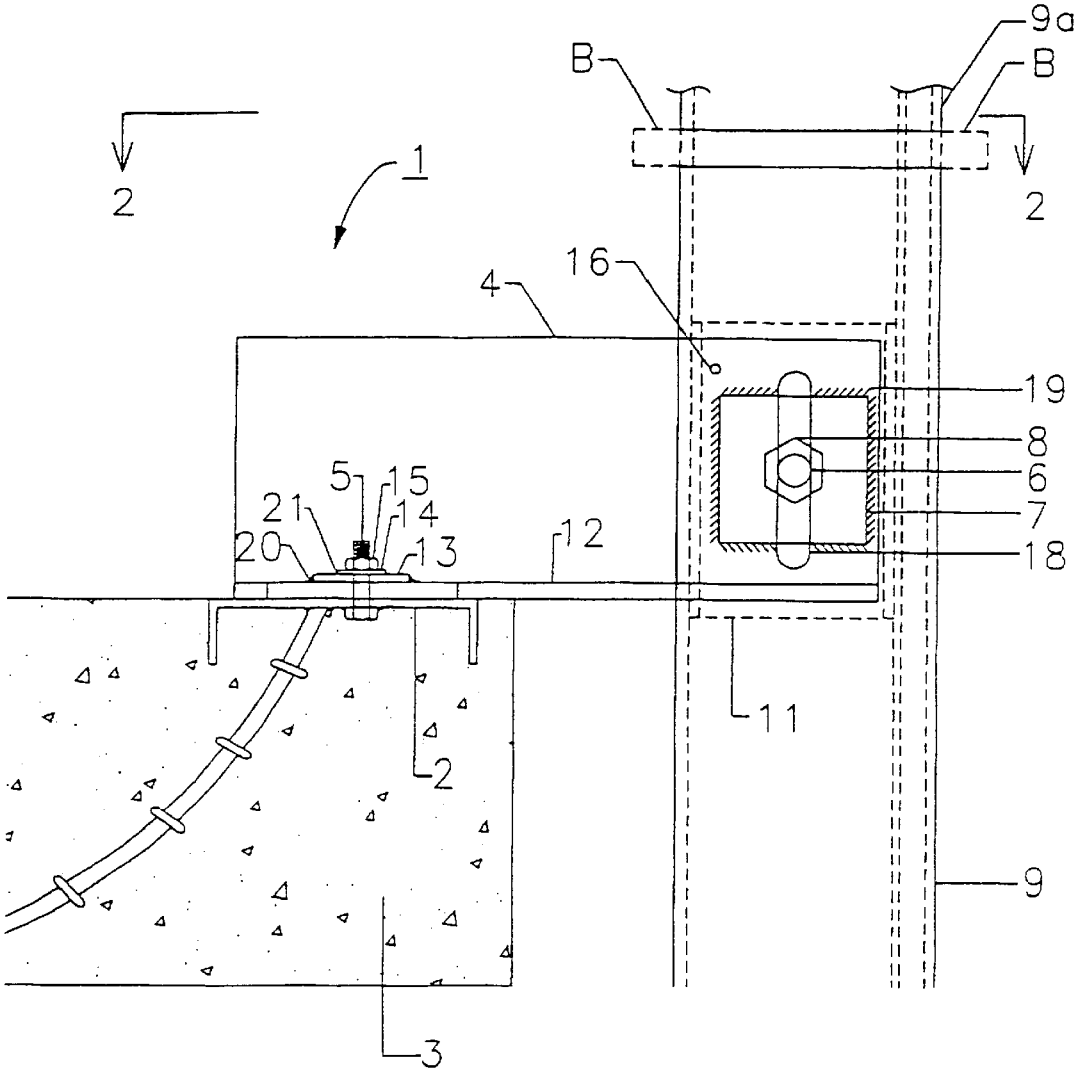
FIG. 1 is a fragmental side view of a preferred mullion connection system of the present invention.
Figure 2:
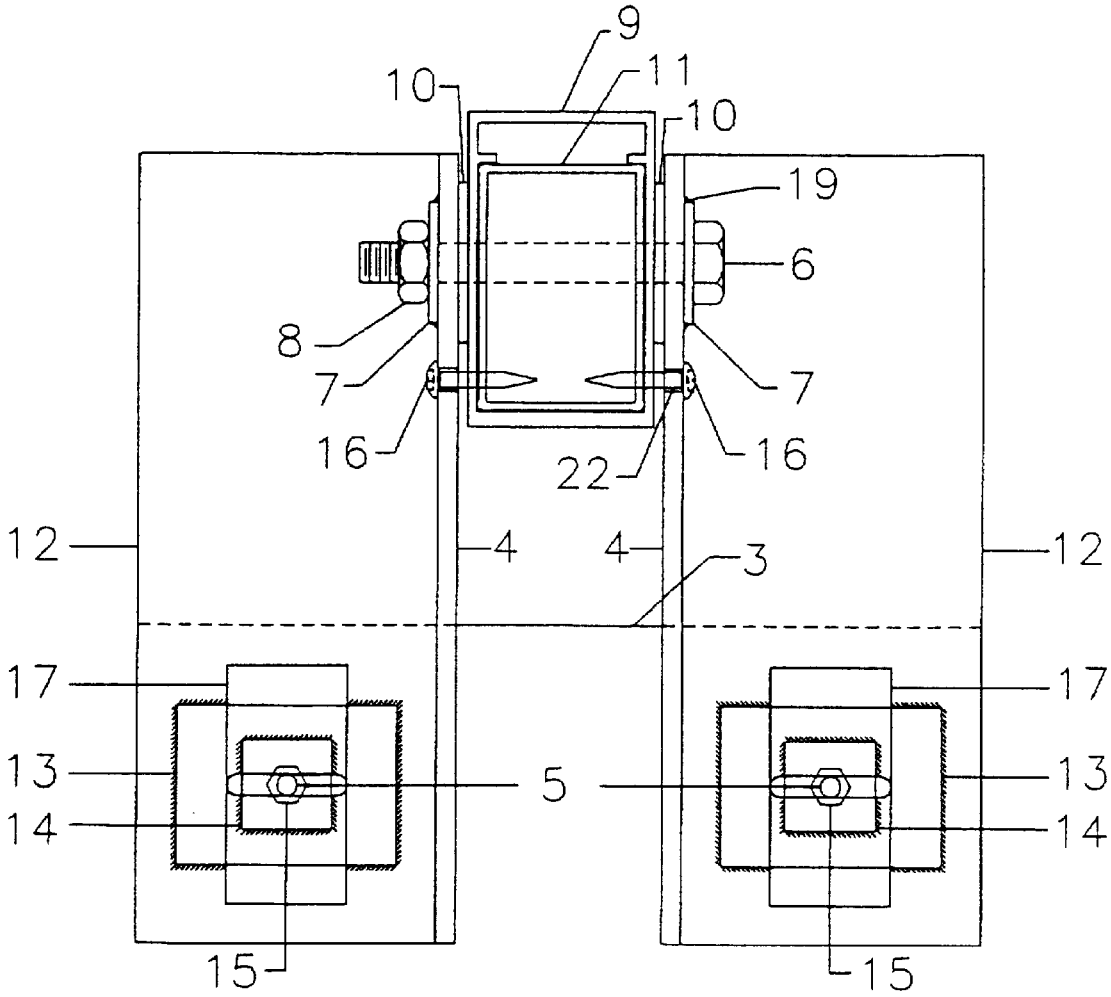
FIG. 2 is the cross-sectional view taken along line 2–2 of FIG. 1 showing the mullion connection system details.

FIG. 1 shows the side view of a preferred mullion connection system 1 of the present invention and FIG. 2 is the cross-sectional top view taken along line 2–2 of FIG. 1. The connection system 1 consists of a conventional preset floor anchoring assembly 2 partially buried inside a concrete floor slab 3 of a building and two mullion connection clips or connectors 4 as shown in FIGS. 1 & 2. The preferred floor anchoring assembly has two spaced-apart anchoring bolts 5 (as shown in FIG. 2) protruding above the floor slab 3. Anchor bolts 5 typically range from about 8 mm to about 30 mm in diameter and protrude above the floor slab by about 30 to 50 mm.

Although the preferred embodiment of the connection system invention uses at least one floor anchor system 2 preset in a building concrete floor 3 to support a mullion or mullion section 9, other building anchors or mullion support devices may also be used in alternative embodiments. Alternative building anchor(s) may be attached by welding or other means to a building's steel framework, use other means for attaching an anchor to a floor slab, or be an integral part of other portions of the building. Although the preferred building anchor system 2 is typically made of steel, other structural materials may also be used.

Figure 4:
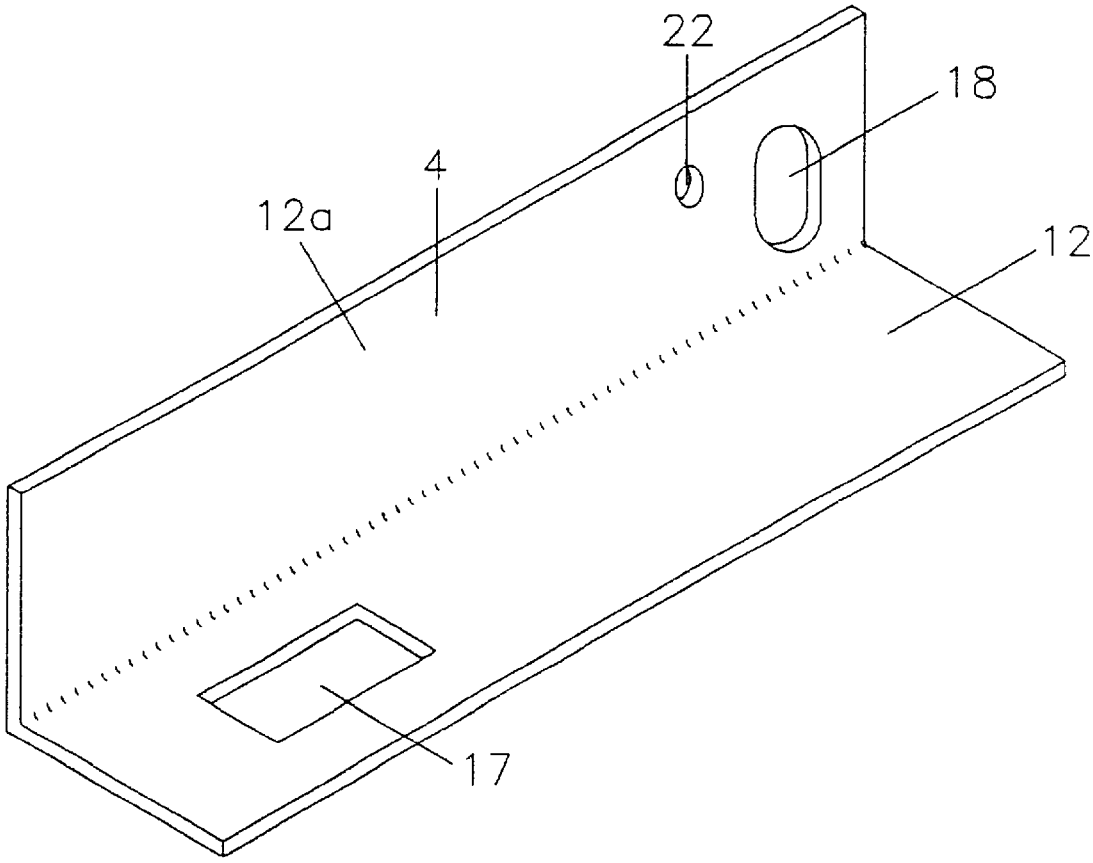
FIG. 4 is an isometric view of a mullion connection clip.

Each mullion connector or clip 4 attached to the anchor assembly 2 is preferably composed of a structural steel angle in sizes ranging from about 3 inch×3 inch (or 8×8 cm) wide by about ¼ inch (or 0.6 cm) thick flanges to about 5 inch×5 inch (or 13×13 cm) wide by about ⅜ inch (or 1 cm) thick flanges and include a first slotted hole or non-circular opening 18 and a second slotted hole or non-circular opening 17 (see, e.g., FIGS. 1 & 4). With reference to FIG. 4, the preferred dimension of the first slotted hole 18 and second slotted hole 17 (through which fasteners 5 & 6 are passed) depends on size of the fasteners and the anticipated building tolerances (including placement tolerances for the anchor assembly 2) at the building attachment location. For a typical set of building tolerances in a multi-story office building having a curtain wall, the first fastener opening 18 and the second fastener opening 17 are preferably sized to have a minimum length of about 30 mm and a minimum width (for the fastener) of about 8 mm. Although FIG. 4 shows one clip 4 for one side of the mullion 9, the preferred other mullion clip 4 (as shown on FIG. 2) would require fabrication of holes/slots in a mirror image configuration.

In alternative embodiments, other connector and flange sizes, shapes and thickness outside the preferred range may be used, e.g., the width of one flange may be different than the other flange, the thickness of one flange may be different than the other flange, portions of the flanges may be ribbed for added strength, and cross sectional geometries of the clip other than an angle may be used, such as an "I" section, a "C" channel, or a box section. In other alternative embodiments, other structural materials may be used for the connector 4, such as aluminum, rigid plastics or fire resistant composite materials.

The first slotted or oblong hole 18 in a first flange or leg 12*a* of connector 4 (see FIG. 4) is preferably sized to absorb a vertical building tolerance between the mullion 9 and the connector while the second rectangular opening 17 in a second flange or leg 12 of the connector is preferably sized to absorb the dimensional building tolerances on the horizontal plane between the fastener building anchor 2 and the connector 4. In alternative embodiments, one or both of the fastener holes 17 & 18 may be rectangular holes, oblong or ellipsoids, irregularly shaped holes, or other means to absorb dimensional tolerances. In still other embodiments circular holes may be used, but having an opening diameter substantially larger than the diameter of the mating fastener to allow positional adjustments of the connector.

The components of a mullion connector or clip 4 include a vertical flange or leg having a height sufficient for carrying the structural load while allowing space for the slotted fastener hole 18. Although a range of heights was given above, the height of the vertical flange should be at least about 2 cm more than the maximum opening dimension (length) of the first slotted fastener hole 18. Similarly, the horizontal flange or leg of mullion connector 4 has a width sufficient to carry the structural load while allowing for the required second fastener hole 17 and the leg width should be at least about 2 cm more than the nominal width of the hole 17. If a left/right adjustable device is included in the building anchor 2, such as a Halfen anchor, the size of the second fastener hole 17 can be altered, e.g., to provide for only in/out adjustment.

Figure 6:
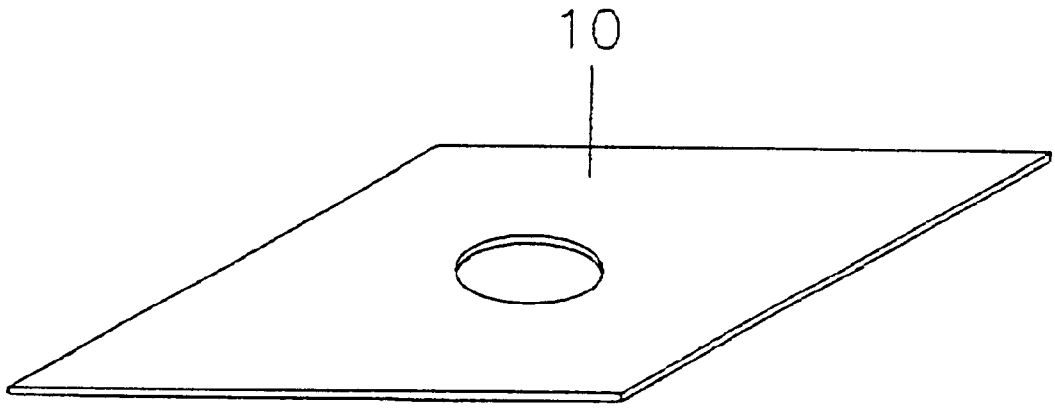
FIG. 6 is an isometric view of an isolation washer.
Figure 7:
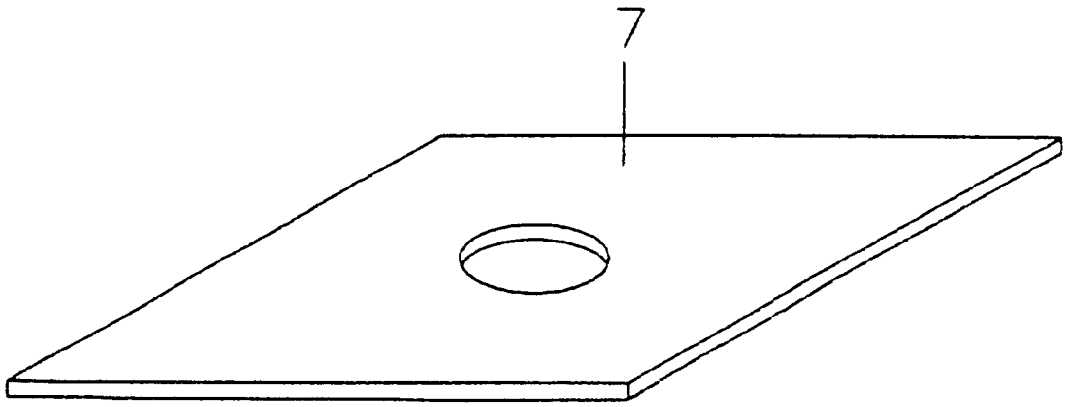
FIG. 7 is an isometric view of a slide prevention washer.

The mullion section or mullion 9 is preferably made of extruded aluminum and is preferably structurally connected to the mullion clips 4 using a mullion bolt 6 and a nut 8 with slide prevention washer 7 (see FIGS. 1 & 7). The most preferable sizes of the steel fasteners or bolts 5 and 6 range from ⅜ inch to ¾ inch (or 1 cm to 2 cm) in diameter. To prevent galvanic corrosion between the preferred aluminum mullion 9 and the preferred steel connectors 4, it is preferred to use an isolation washer 10 (see FIG. 6) made of an insulating material, such as some types of stainless steel or rigid plastic, between the mullion 9 and the clips 4.

The mullion 9 is assembled and connected to other mullions end-to-end (e.g., see connecting mullion 9*a* connected to supported mullion 9 in FIG. 1) to create a generally vertical mullion assembly that supports a plurality of curtain wall panels (not shown for clarity). Although each mullion section may be at least partially supported by connected mullion sections, the primary support for each mullion section in the preferred assembly is provided by the attached connection system 1.

Figure 8:
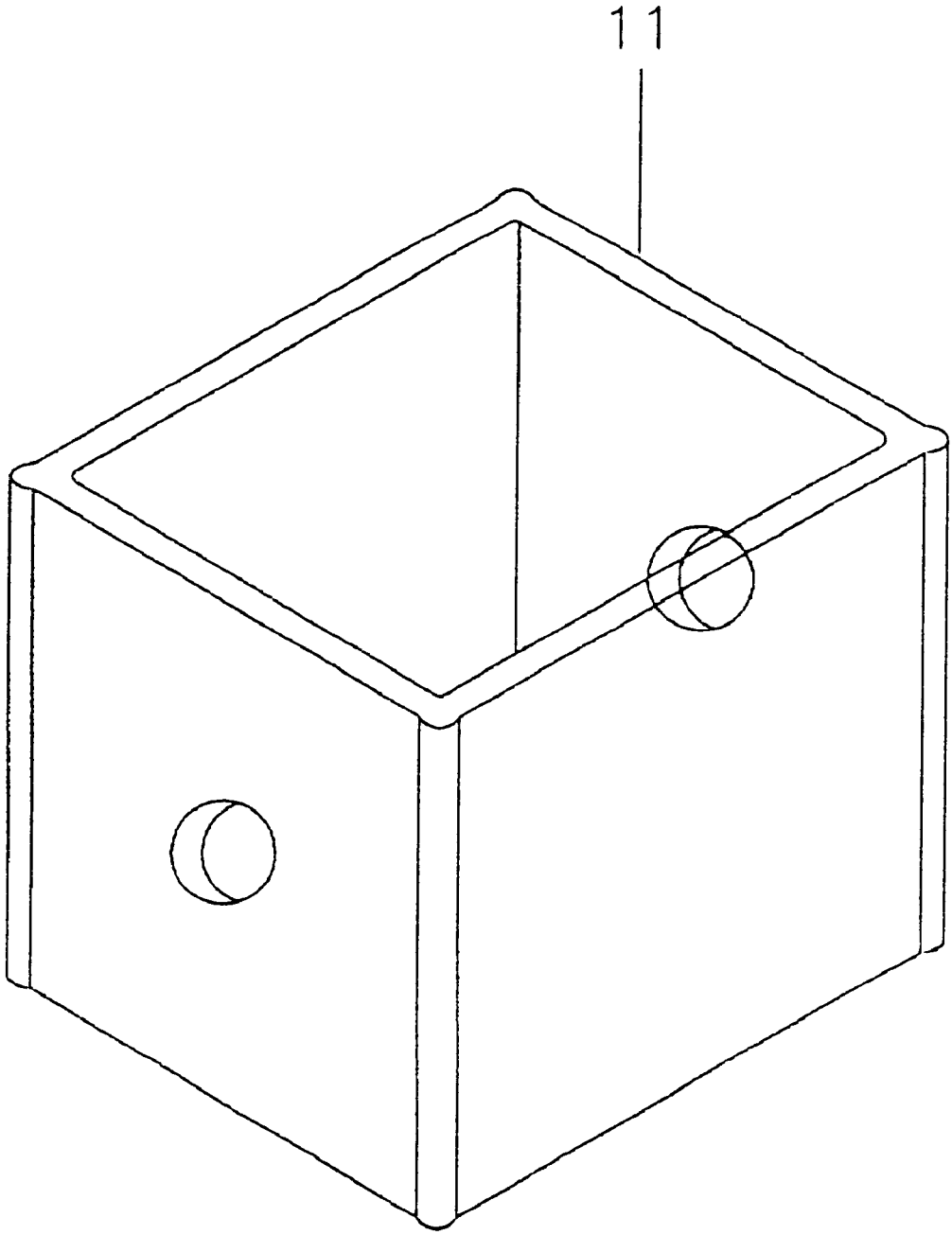
FIG. 8 is an isometric view of a mullion splice tube.

The strength of the connection system 1 at the mullion bolt 6 may be limited by either the bearing strength of the web of the mullion 9 on the bolt 6 or the strength of bolt 6 in double shear. In some applications, the bearing strength of the web portion of mullion 9 bearing on the bolt 6 governs the strength of the connection system 1 and may require two bolts and web bearing surfaces to achieve adequate strength. In the preferred embodiment, a mullion splice tube 11 (see FIG. 8) is used at the location of bolt 6 to effectively increase the web bearing area and avoid the need for a second bolt. By selecting adequate mullion and splice tube web thickness and materials of construction, a single bolt connection can be designed for a required connection load in most applications. The preferred material of construction for the mullion splice tube is aluminum and the preferred design location of bolt 6 is at the midpoint of the slotted hole 18, but other structural materials and design locations can be used in alternative embodiments.

Figure 5:
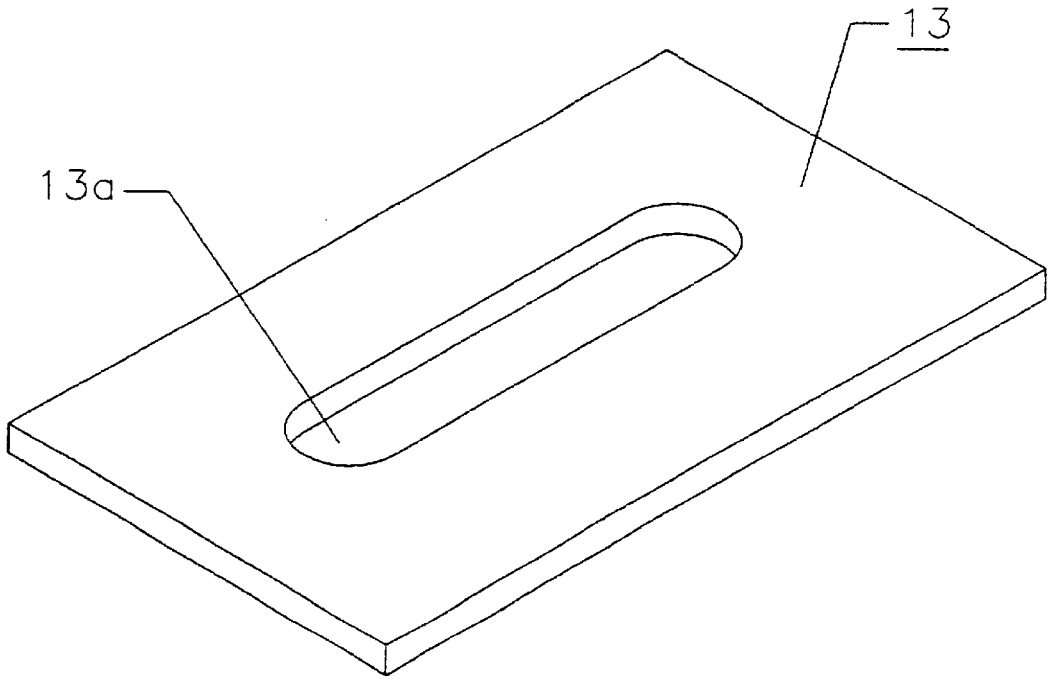
FIG. 5 is an isometric view of a compression plate.

The horizontal leg 12 of the mullion clip 4 (see FIG. 4) is preferably secured to the floor anchoring assembly 2 by the compression plate 13, the slide prevention washer 14, the nut 15, and the anchor bolt or fastener 5. The theoretical location of the anchor bolt 5 is preferably designed to be at the center of hole 17. The preferable thicknesses of the compression plate 13 range from about ⅛ inch to ¾ inch (or 0.3 to 2 cm). The preferable thicknesses of the slide prevention washer 14 and slide compression plate 13 (as shown in FIG. 5) range from about 1/16 inch to ⅛ inch (or 1.5 to 3 mm). The preferable thicknesses of the isolation washer range from about 0.04 to 0.1 inch (or 1 to 2.5 mm) for stainless steel and from about ⅛ inch to ¼ inch (or 3 to 6 mm) for rigid plastic. The preferred dimensions of the plate fastener slot 13*a* (see FIG. 5) typically range from about 1.5 to 4 inches (or 4 to 10 cm) long. The width of the slot 13*a* should be sized to fit the diameter of anchor bolt 5.

Although other structural materials of construction may be used, the slide prevention washers 7 and 14 (as shown on FIG. 7) are preferably composed of steel. The preferred overall dimensions of the slide prevention washers 7 & 14 typically ranges from about 1.5 to 4 inches (or 4 to 10 cm) wide by about 1.5 to 6 inches (or 4 to 15 cm) long. In an alternative embodiment, the slide prevention washer may be eliminated by applying permanent structural screws 16 (see FIGS. 1 & 2) to resist the dead weight of the mullion assembly and curtain wall system supported by the mullion assembly.

Figure 3:
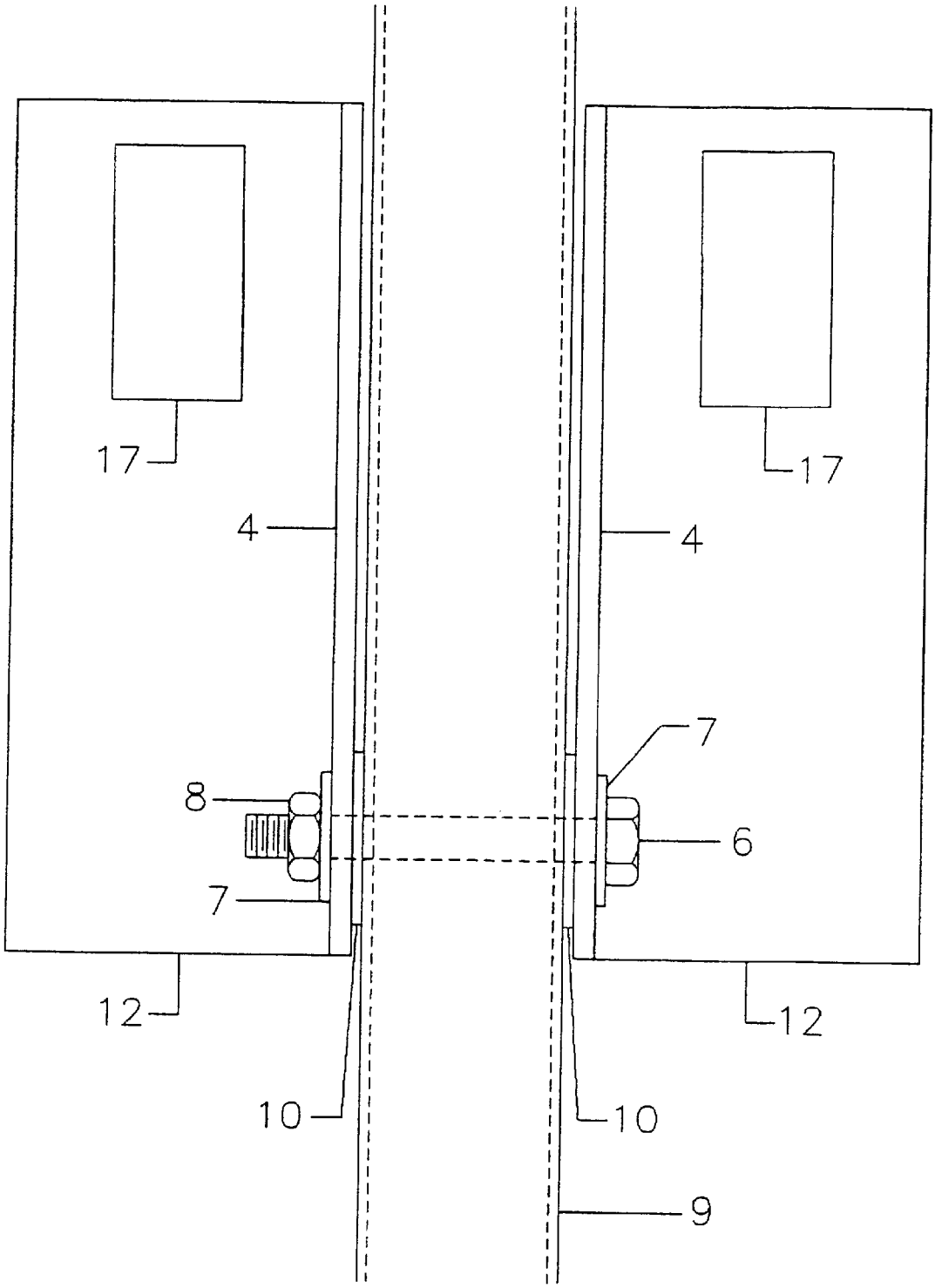
FIG. 3 is the front view of a mullion with preferred shop-secured mullion connection clips in a shipping position.

The installation procedures are explained especially with reference to FIGS. 1, 3, & 4. The mullion clips 4 (see FIG. 4) are preferably shop assembled with the mullion 9 in a first or shipping position (shown in FIG. 3) of the connector and mullion assembly with the nut 8 tightened to fastener 6 (preferably loosely tightened) using slide prevention washers 7 such that the major length of mullion clips 4 is generally parallel to the major length of the mullion 9 as shown and will remain in this configuration during shipping and lifting of the connector and mullion assembly. Upon arriving at the job site, at least one of the mullion clips 4 and slots 17 in the shipping position can be conveniently utilized as the lifting ears for hoisting the mullion and connector assembly into a desired position proximate to the building and above previously installed mullions 9. Once a lifted mullion and connector assembly has been spliced at the bottom of the mullion with the top of an already installed mullion below (see the top of mullion 9 spliced to the bottom of mullion 9*a* in FIG. 1), an optional gage block "B" (shown dotted in FIG. 1) is preferably placed at the spliced mullion joint to maintain a desired gap at the mullion joint. The desired gap and gage block preferably range from about 0.4 to 0.8 inches (or 1 to 2 cm). In alternate embodiments, the optional gage block B may be replaced with a gap filler, sealing material, or avoided altogether.

The weight of the upper mullion section 9*a* (being installed on previously installed mullion 9) is allowed to temporarily seat on the gage block or is temporarily supported at the desired vertical height. The nut 8 is preferably loosened and the mullion clip 4 rotated about 90 degrees from its first position to allow the horizontal leg 12 of mullion clip 4 to be seated on top of the floor slab 3. At this condition of the connector 4 and mullion 9 resting on the gage block B at the desired height to provide a desired gap, the bolt 6 may slide up or down along the slotted hole 18, automatically accomplishing the preferred vertical adjustment within the building tolerances. The nut 8 is then tightened and an optional screw 16 inserted into the hole 22 of clip 4 to bear against or penetrate the mullion 9 as shown in FIG. 4. The screw hole 22 is preferably sized to mate with the screw 16 and prevent the mullion 9 from sliding downward before providing a weld 19 as shown in FIG. 1. After the screw 16 is in place and tightened, the compression plate 13 and the slide prevention washer 14 are preferably placed as shown in FIG. 1 and nut 15 is preferably hand tightened.

In this hand tightened condition (and especially if gage blocks "B" are removed), the mullion 9 is at least partially supported and stabilized by the connection system 1 contacting the top surface of the floor slab 3 at the bottom surface of the leg 12 of clip 4, allowing rotational adjustment (including very fine rotational adjustment), in/out adjustment, and left/right adjustment of the mullion 9 without substantial additional support, e.g., adjustment can be accomplished by tapping on the mullion clips 4 in a horizontal plane since fastener hole 17 allows free movement of the mullion clip 4 in two directions. Although once the final or desired position of the mullion 9 (and clip 4) is reached, the nut 15 can be tightened to retain the installed or design configuration of the mullion and connector assembly while bending on the compression plate 13 due to the nut tightening force secures the mullion in the design position, welding of the components in the desired position is preferred. Preferably, a welding crew can provide first weld 19 before the curtain wall panels are assembled and fix the position of the slide prevention washer 7 to the mullion clip 4. In an alternative embodiment, if the screws 16 are designed to be sufficient to resist the dead weight of the supported mullion and curtain wall portions, the slide prevention washer 7 and weld 19 can be eliminated. For this purpose, more than two screws 16 can also be used in still other alternative embodiments. In another alternative embodiment, the combination of a round hole in the clip 4 and a slotted hole in the mullion 9 (having a narrow opening dimension similar to the round hole in clip 4 and a larger dimension measured along the slot) can also accomplish the same design objective. In the preferred embodiment, a second weld 20 fixes the compression plate 13 to the horizontal leg 12 of the mullion clip 4 and a third weld 21 fixes the slide prevention washer 14 to the compression plate 13.

Many other connector and mullion connector profiles can be configured to create a means for adjustably connecting a mullion section to a building from the concepts disclosed in the preferred and alternative embodiments that provide a connection system that allows 4 degrees of motion for a connected mullion 9 while the mullion is at least partially supported in place by the connection system. Materials with adequate structural strength such as steel and aluminum are utilized to make the preferred mullion connection system 1, but other structural materials and geometries can also be incorporated. The mullion 9 can also vary in shape or form, e.g., exterior flange "EF" of the mullion can be varied to adapt to supporting various curtain wall panel and system shapes.

Another significant advantage of the present invention is that the same mullion connection system can be used in inside corner or outside corner applications. For example, the alignment and positioning of a mullion at a corner location can be adjusted to adapt to corner building tolerances and two adjacent mullions in different planes. The inventive connection system can also be used with more conventional curtain wall connection systems, e.g., in a retrofit application to position and support a replacement mullion where at least one adjacent mullion is supported by more conventional means.

While the preferred embodiment of the invention has been shown and described, and some alternative embodiments also shown and/or described, changes and modifications may be made thereto with departing from the invention. Accordingly, it is intended to embrace with the invention all such changes, modifications, and alternative embodiments as fall with in the spirit and scope of the appended claims.

What is claimed:

1. An apparatus for securing a curtain wall assembly to a building comprising:

a support member for supporting at least a portion of said curtain wall assembly from said building, said support member comprising a first flange substantially in a first plane and a second flange substantially in a second plane that is generally perpendicular to said first plane and wherein said first flange also comprises a first fastener slot capable of allowing relative linear motion in at least one direction between a first fastener and said first flange and rotation of said first flange around said fastener when said first flange is connected to said first fastener, wherein said second flange comprises a second fastener opening capable of allowing relative linear motion in at least two directions between a second fastener and said second flange and rotation of said second flange around said fastener when said second flange is connected to said second fastener;

fasteners for connecting said support member to said building and for connecting said support member to at least a portion of said curtain wall assembly; and a mullion section connected to said support member and at least a portion of said curtain wall assembly.

2. The apparatus of claim 1 which also comprises a retainer plate for restricting said relative motion located proximate to one of said fastener openings and retained by one of said fasteners proximate to one of said flanges.

3. The apparatus of claim 2 wherein said retainer plate comprises a compression plate which is capable of being at least partially deformed by one of said fasteners.

4. The apparatus of claim 3 which also comprises a slide prevention washer located proximate to one of said fastener openings and retained in said location by said fastener.

5. The apparatus of claim 4 which also comprises a mullion splice tube connected to said mullion.

6. The apparatus of claim 5 which also comprises a fastener for fastening said support member to said mullion splice tube.

7. A method of attaching a mullion section to a building anchor comprising:

placing a mullion clip at a first position to connect with said building anchor wherein said mullion clip is capable of being rotated in a plane and repositioned with respect to said building anchor in at least two orthogonal directions;

connecting a mullion section to said mullion clip wherein said mullion section is capable of being rotated in a plane and repositioned with respect to said building anchor in at least one direction; and repositioning said mullion clip in at least one direction with respect to said building anchor after said connecting step and when said mullion section is at least partially supported by said building anchor.

8. The method of claim 7 which also comprises the steps of securing said mullion clip to said building anchor after said repositioning step.

9. The method of claim 8 which also comprises the steps of:

temporarily supporting said mullion section on a gage block;

loosely securing said mullion section to said mullion clip after said connecting step; and removing said gage block and more securely securing said mullion section to said mullion clip after said repositioning step.

* * * * *